United States Patent [19]

Ahrens

[11] 4,369,965

[45] Jan. 25, 1983

[54] PLAYGROUND CLIMBER AND SLIDE

[75] Inventor: Paul W. Ahrens, Grinnell, Iowa

[73] Assignee: Miracle Recreation Equipment Company, Grinnell, Iowa

[21] Appl. No.: 195,671

[22] Filed: Oct. 9, 1980

[51] Int. Cl.[3] ..... A63B 9/00

[52] U.S. Cl. ..... 272/56.5 R; 272/113; 46/25; D21/244

[58] Field of Search ..... 272/56.5 R, 62, 63, 272/109–113, 1 R; D21/242–246; 46/25–31; 220/66, DIG. 13; 211/74

[56] References Cited

U.S. PATENT DOCUMENTS

| | | | |
|---|---|---|---|
| D. 207,105 | 3/1967 | Gale | D21/244 |
| D. 218,455 | 8/1970 | Dattner | 272/113 X |
| D. 218,456 | 8/1970 | Dattner | D21/245 |
| D. 218,460 | 8/1970 | Dattner | 272/113 X |
| D. 218,765 | 9/1970 | Dattner | D21/245 X |
| D. 219,603 | 12/1970 | Wormser | D21/245 |
| 3,472,509 | 10/1969 | Flynn | 272/113 |
| 3,632,109 | 1/1972 | Dattner | 272/56.5 R |
| 3,666,266 | 5/1972 | Noguchi | 272/113 |
| 3,746,178 | 7/1973 | Wagschal | 46/31 X |

FOREIGN PATENT DOCUMENTS

| | | | |
|---|---|---|---|
| 2218560 | 10/1973 | Fed. Rep. of Germany | 272/56.5 R |
| 911322 | 11/1962 | United Kingdom | 272/109 |
| 1486243 | 9/1977 | United Kingdom | 272/113 |

*Primary Examiner*—Richard J. Johnson

*Attorney, Agent, or Firm*—Zarley, McKee, Thomte, Voorhees & Sease

[57] ABSTRACT

An A-shaped playground climber is formed from a pair of spaced apart end pieces which include outer peripheral rims having eight flat surfaces. Extension legs extend from the vertical surfaces to the ground and steps bridge adjacent legs and diagonal surfaces of the end pieces to provide steps along each of the legs of the A-shape structure. A tube is received in axial openings in each of the end pieces and a slide extends from the top of one of the end pieces to the ground. A second embodiment is also A-shaped but comprises four pairs of end pieces, three pairs in abutting relationship on the ground with a fourth pair on top of the center pair on the ground. Pairs of extension legs bridge adjacent end pieces to provide continuous legs of the A-shaped structure and steps are provided therealong. A slide on one side of the A-shaped structure extends from the ground to the juncture of the abutting horizontal surfaces of the top and bottom center end pieces.

33 Claims, 10 Drawing Figures

PLAYGROUND CLIMBER AND SLIDE

BACKGROUND OF THE INVENTION

Multi-purpose playground equipment is desirable and should include component parts which are capable of being selectively assembled to provide different structures. The equipment should take advantage of the popular materials available including fiberglass, wood and metal. The equipment should also be modernistic in appearance, sturdy and challenging to use. The equipment should also be easily assembled and safe to use.

SUMMARY OF THE INVENTION

The basic unit that has unlimited construction possibilities includes spaced apart end pieces octangular in shape which may or may not be interconnected by a tube received in aligned axial center openings. A slide may be attached to the top of one such unit or four units may be assembled, three along the bottom and one on top of the bottom center unit with extension legs interconnecting adjacent ends to form the A-shape structure. The slide may extend from the ground to the juncture of the center bottom unit and the top unit. Aligned openings through the end pieces with or without tubes provide for a play area within the structure and an access route to the slide. Steps along each of the legs of the A-shaped structure provide access to the top from either side.

DESCRIPTION OF THE PREFERRED EMBODIMENT

Figure 1:
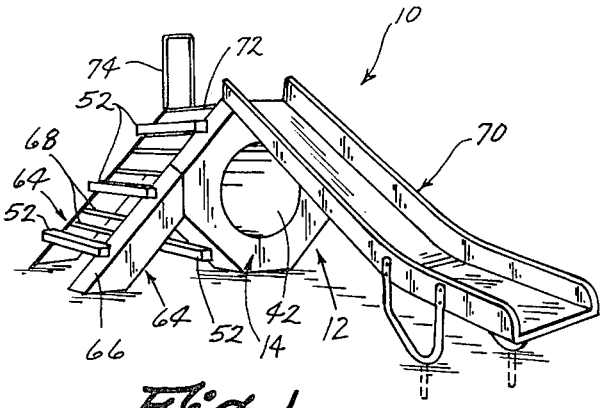
FIG. 1 is a perspective view of a playground climber and slide utilizing a single pair of end pieces interconnected by a tube.
Figure 6:
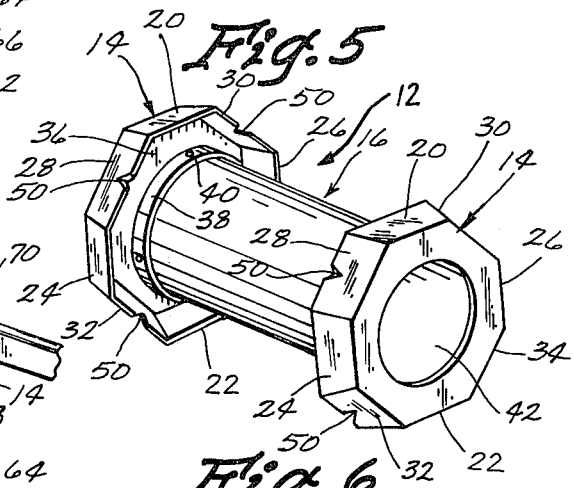
FIG. 6 is a perspective view of a unit including a pair of end pieces and interconnected by a tube.
Figure 7:
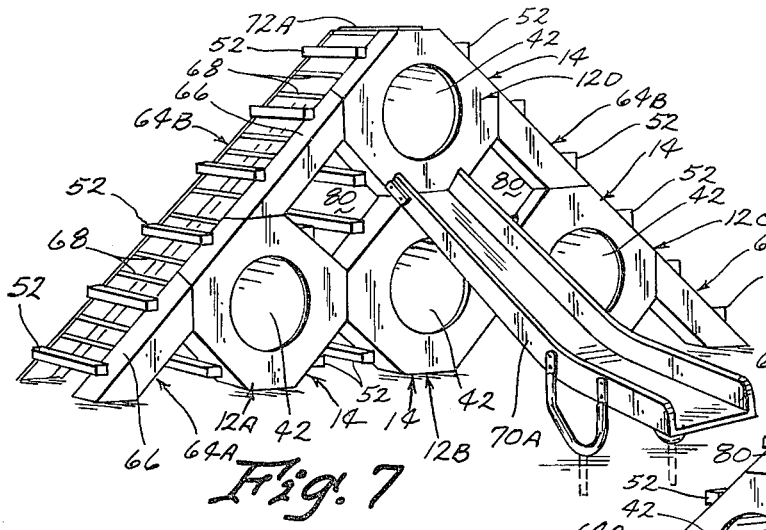
FIG. 7 is a perspective view of an alternate embodiment.
Figure 8:
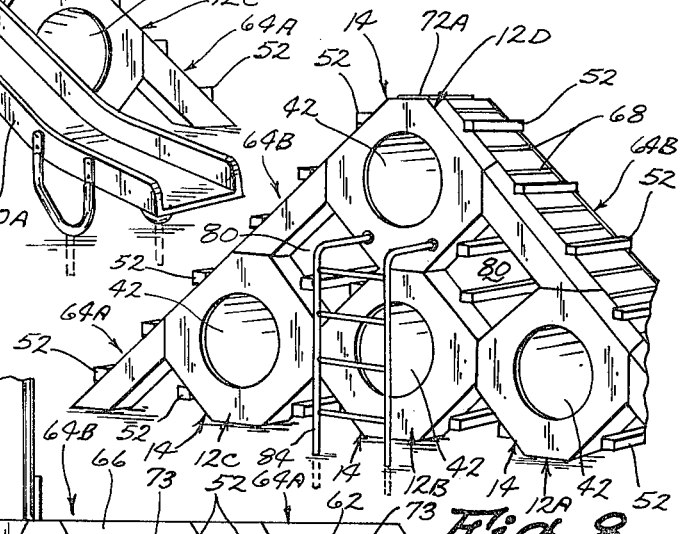
FIG. 8 is a perspective view of the backside of the unit of FIG. 7.
Figure 9:
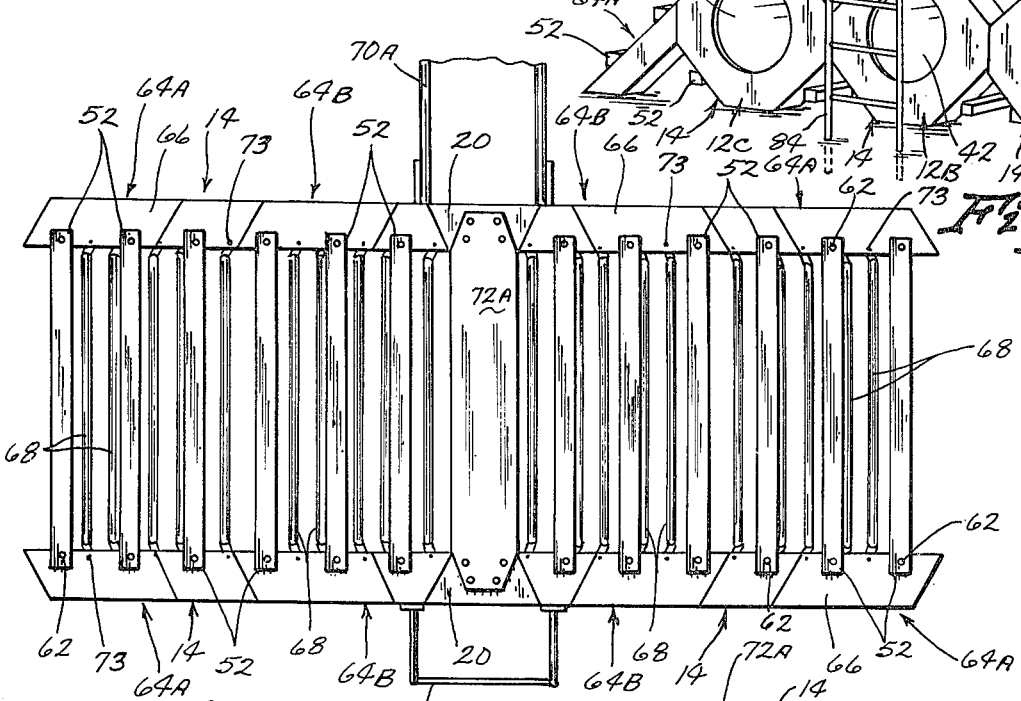
FIG. 9 is a fragmentary top plan view thereof.

The playground climber and slide of FIGS. 1–6 is referred to generally in FIG. 1 by the reference numeral 10 and includes a single unit 12 as shown in FIG. 6. The unit 12 comprises a pair of end pieces 14 interconnected by a tube 16. The end pieces are octangular in shape with a rim having top and bottom surfaces 20 and 22, opposite vertical surfaces 24 and 26, top diagonal surfaces 28 and 30, and bottom diagonal surfaces 32 and 34. A radially extending flange 36 interconnects an inner flange 38 to the outer rim. The inner flange 38 is fastened by bolts 40 to the wall of the tube 16. An axial opening 42 is provided in each end piece 14 which in turn communicates with the passageway in the tube 16.

Figure 2:
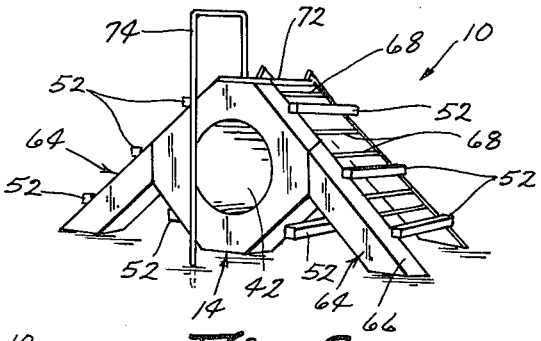
FIG. 2 is a perspective view of the equipment from the backside as viewed in FIG. 1.
Figure 10:
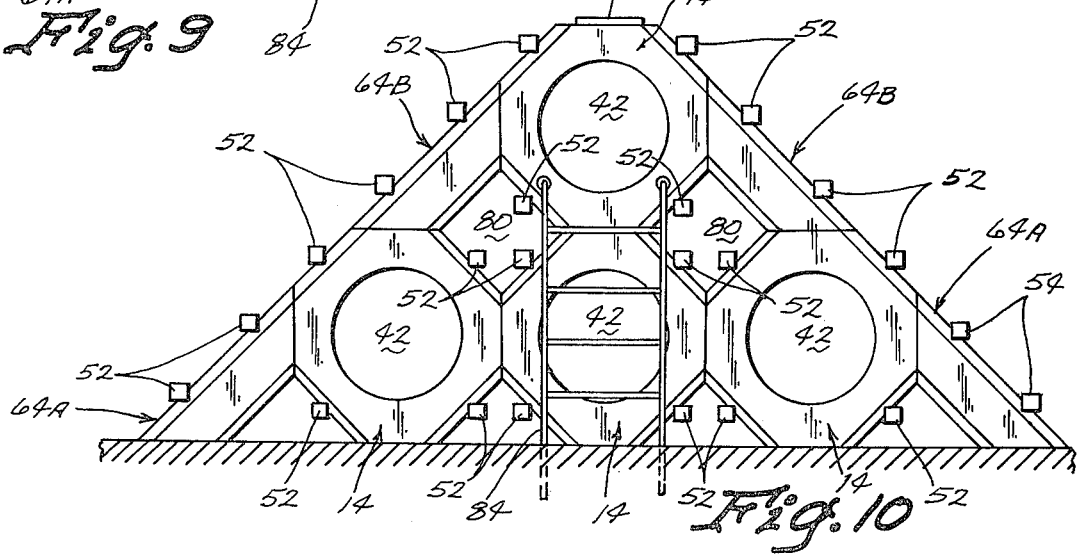
FIG. 10 is a elevational view of the backside of the unit.

The vertical and horizontal surfaces are substantially parallel to the longitudinal axis of the tube 16 while the diagonal surfaces flare outwardly as much as thirty to forty degrees and include notches 50 along their outer edges which receive opposite ends of wooden steps 52 which are also secured in place by vertically and horizontally extending bolts 60 and 62 as can be seen in the drawings, particularly in FIGS. 1, 2 and 10, the notches 50 (shown in FIG. 6) of the diagonal surfaces allow rectangular in cross-section wooden steps 52 to be placed between opposite end pieces so that wooden steps 52 present a horizontally flat top surface for stepping.

A pair of extension legs 64 abutt at their upper ends to the vertical surfaces 24 and include top upwardly flared surfaces 66 also having notches for receiving the wooden square in cross section steps 52 bolted thereto. All abutting surfaces are interconnected by bolts although not shown.

Secondary metal steps 68 extend between oppositely disposed surfaces on the legs and the end pieces and include ears 71 connected by bolts 73 to the diagonal surfaces of the rims and the top surfaces 66 of the extension legs 64.

Figure 3:
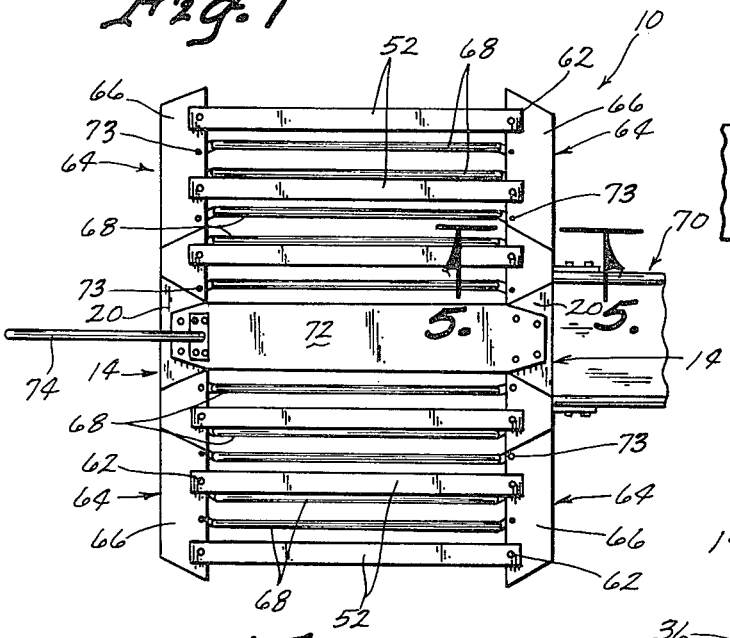
FIG. 3 is a fragmentary top plan view thereof.
Figure 5:
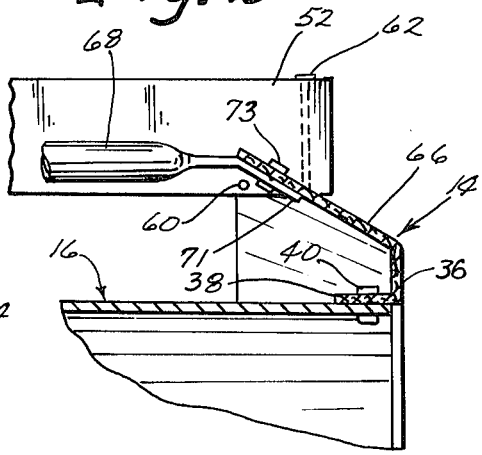
FIG. 5 is a cross sectional view taken along line 5—5 in FIG. 3.
Figure 4:
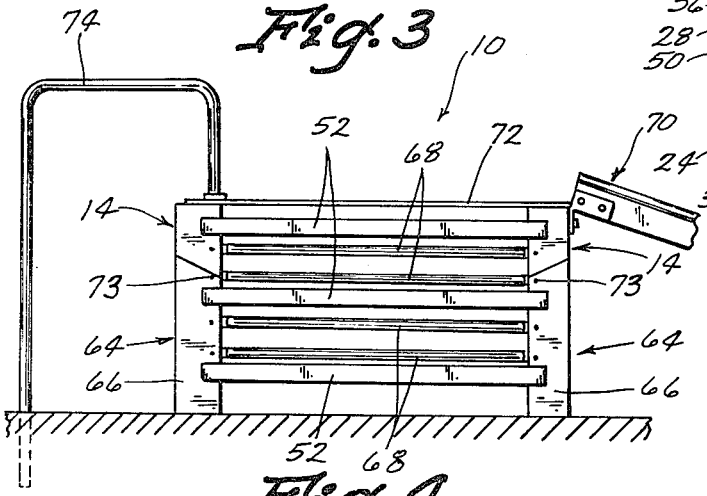
FIG. 4 is a side elevational view taken from the right side as viewed in FIG. 2.

The slide bed 70 extends from the top bridge plate 72, as seen in FIG. 3, to the ground, as seen in FIG. 1. A fireman's post 74 extends from the opposite end of the bridge plate 72 to the ground.

Thus it is seen that an A-shaped structure is provided which has steps along the length of both legs of the structure.

In FIGS. 7–10 an alternate embodiment is shown also A-shaped but including four pairs of end pieces 14. There are three pairs of end pieces in side-by-side relationship on the ground, 12A, 12B and 12C, respectively. A fourth pair 12D are positioned atop of the pair 12B. A first pair of extension legs 64A extend from the ground to the outer vertical surfaces on the end pieces 12A and 12E while a second pair of extension pieces 64B interconnect the top surfaces of end pieces 12A and 12E to the outer vertical surfaces of end pieces 12D. Steps 52 and 68 are provided as in the unit 10. A top bridge plate 72A is provided on the top horizontal surfaces of the end pieces 12D. Each of the end pieces may or may not have a tube 16 interconnecting the end pieces and wood steps 52 may also be provided on the interior diagonal surfaces to provide increased strength and protect against children getting inside the structure if this is not desired or for simply providing a passageway through the structure as seen by the two openings 80 in FIG. 10.

The slide bed 70A extends from the ground to the juncture of the horizontal surfaces of the adjacent end pieces of 12B and 12D and thus provide access to the slide from the opening 42 in the end pieces 12D.

The materials used in the structure include metal for the slide bed and tubes while the extension legs and end pieces are fabricated from fiberglass. As indicated, the steps 52 are of wood and the steps 68 are of tubular metal.

The side opposite the slide 70A includes a ladder 84 for providing access to the opposite end of the opening 42 in the end pieces 12D.

Thus it is seen that any number of different number of combinations of basic component end pieces 14 may be arranged to provide a climbing device and/or slide. Climbing is over the top and through the axial centers of the units 12 as well as through openings 80 formed by adjacent extension legs and units 12.

I claim:

1. An end piece for a playground climber, said end piece being adapted to be vertically disposed and having a center axial horizontal opening and a radially extending flange terminating in a rim having eight flat end-to-end surfaces including two oppositely disposed vertical surfaces, two oppositely disposed horizontal surfaces and two pairs of oppositely disposed diagonal surfaces, said vertical and horizontal surfaces being parallel to said horizontal axial opening and said diagonal surfaces being flared outwardly thereto to present a step mounting edge.

2. The structure of claim 1 wherein said diagonal surfaces include V-shaped notches in their outer edges and said V-shaped notches have horizontal and vertical surfaces adapted to matingly engage contiguous corner surfaces of a step member.

3. The structure of claim 1 wherein said center axial horizontal opening has an axially extending inner flange surrounding said center axial horizontal opening for attachment of inter-connecting pieces to other said end pieces.

4. The structure of claim 1 wherein said center axial horizontal opening has an axially extending inner flange surrounding said center axial horizontal opening for attachment of a tubular inter-connecting piece of approximately the same diameter of said center axial horizontal opening, said tubular inter-connecting piece being connected at its other end to said axially extending inner flange of another said end piece.

5. A playground climber comprising, an elongated tube having oppositely disposed enlarged end pieces and being open along its center axial length, and said end pieces each having a center axial opening in which an end of said tube is received, and a radially outwardly extending flange is provided having a rim perpendicular thereto including a plurality of end-to-end flat surfaces, said end pieces each having an inner flange embracing an end of said tube and said rims extend longitudinally inwardly towards each other, and said end pieces being identical and in alignment, step members extending between selected corresponding flat surfaces on said opposite end pieces parallel to and in spaced relation to said tube.

6. The structure of claim 5 wherein extension legs extend from corresponding selected other flat peripheral surfaces and step members extend between said extension legs to provide a series of steps on said climber.

7. The structure of claim 6 wherein a slide bed extends from the top most flat peripheral flat surface on one end piece to the ground.

8. The structure of claim 5 wherein second and third elongated tubes having oppositely disposed enlarged end pieces are disposed in parallel abutting relation to said first tube and a fourth tube is disposed on top of said first tube with adjacent flat peripheral surfaces on adjacent tube end pieces abutting against each other and extension leg portions extending between said second and third tube end pieces and said fourth tube end pieces and said second and third tube end pieces and the ground to provide an A shaped structure.

9. The structure of claim 8 wherein a slide extends from the center area of one side of said structure to the ground.

10. The structure of claim 9 wherein said slide engages the side of said structure at the juncture of said flat surfaces of the adjacent end pieces at one end of said fourth and first tubes whereby access to the top of said slide is from the inside of said fourth tube.

11. The structure of claim 10 wherein a stair means is provided from the ground to the other end of said fourth tube.

12. The structure of claim 11 wherein said step members provide oppositely disposed stairs from the ground to the top of the fourth tube and include step members extending between corresponding outer surfaces on said extension legs.

13. The structure of claim 12 wherein the outer peripheral flat surfaces to which step members are connected flare radially outwardly relative to the axial center of said tube and include notches in the outer peripheral edge for receiving the step members.

14. The structure of claim 13 wherein said extension legs have outer outwardly flared flanges including notches in their outer peripheral edges for receiving said step members.

15. The structure of claim 14 wherein said step members are square in cross section.

16. The structure of claim 15 wherein secondary step members are provided between said step members.

17. The structure of claim 16 wherein said abutting surfaces on adjacent end pieces and said extension members are either vertically or horizontally disposed and said step members engage diagonally extending surfaces on said extension members and said end pieces.

18. The structure of claim 17 wherein a first opening parallel to said tubes through said climber is formed by the extension leg extending between said second and fourth end pieces and adjacent diagonal surfaces on said first, second and fourth end pieces, and a second opening is formed by the extension leg extending between said third and fourth end pieces and adjacent diagonal surfaces on said first, third and fourth end pieces.

19. A playground climber comprising, four pairs of spaced apart end pieces, each end piece having an outer rim including eight sides, two vertical, two horizontal and four diagonal, a first pair of end pieces being between and abutting a second and third pair and a fourth pair being positioned on top of said first pair, a first and second pair of extension legs extending from the ground to the outer vertical surfaces of said second and third pair of end pieces, third and fourth pairs of extension legs extending between top horizontal surfaces of said second and third pairs of end pieces to the outer vertical surfaces of said fourth pair of end pieces, and said four pairs of end pieces forming an A-shaped structure and steps are provided between adjacent end pieces and adjacent extension legs to provide steps along each leg of said A-shaped structure.

20. The structure of claim 19 wherein a slide bed extends from the abutting horizontal surfaces of end pieces at one end to said first and fourth pair of end pieces to the ground.

21. The structure of claim 20 and said fourth pair of end pieces have an aligned axial opening providing access to the top of said slide.

22. The structure of claim 21 and said aligned axial openings of said fourth pair of end pieces receive the opposite ends of a tube open along its length.

23. The structure of claim 19 wherein each of said pairs of end pieces have aligned axial openings.

24. The structure of claim 23 wherein tubes are received in the aligned axial openings of each pair of end pieces.

25. The structure of claim 23 wherein the outer rim of said end pieces along said outer diagonal surfaces is flared outwardly and includes notches in the outer edges in which said steps are positioned.

26. The structure of claim 25 wherein the top surfaces of said extension legs are upwardly flared and have notches in their outer edges in which said steps are received.

27. A playground climber and slide comprising, a pair of spaced apart end pieces of substantially identical shape, each end piece having a center axial opening and a radially extending flange terminating in a rim having eight flat surfaces including two oppositely disposed vertical surfaces, two oppositely disposed horizontal surfaces and two pairs of oppositely disposed diagonal surfaces, a slide bed extending from the top horizontal surface to the ground, a pair of oppositely disposed extension legs extending from each pair of opposite vertical surfaces to the ground, and steps extending between adjacent extension legs and between adjacent diagonal surfaces to provide an A-shaped structure having a ladder on each leg to the top horizontal surfaces for access to the top of the slide.

28. The structure of claim 27 wherein a tube is received in the axial openings of said end pieces.

29. A playground climber comprising, an elongated tube having oppositely disposed enlarged end pieces and being open along its center axial length, said end pieces each having substantially identical shape and having a center axial opening in which said tube is received, and a radially extending flange terminating in a rim having eight flat surfaces including two oppositely disposed vertical surfaces, two oppositely disposed horizontal surfaces and two pairs of oppositely disposed diagonal surfaces, said horizontal and vertical surfaces being parallel to said center axial opening and said diagonal surfaces flaring outwardly at angle to the said center opening.

30. The structure of claim 29 wherein the flare of said diagonal surfaces is between 30 to 40 degrees.

31. The structure of claim 29 wherein said diagonal surfaces include notches in their outer edges and opposite ends of step members are received therein.

32. The structure of claim 31 wherein said notches have horizontal and vertical surfaces for mating engagement with contiguous corner surfaces of said steps, said steps having a plurality of flat exterior surfaces.

33. A playground climber comprising, a pair of spaced apart end pieces of substantially identical shape, each end piece having a center axial opening and a radially extending flange terminating in a rim having eight flat surfaces including two oppositely disposed vertical surfaces, two oppositely disposed horizontal surfaces and two pairs of oppositely disposed diagonal surfaces, a pair of oppositely disposed extension legs extending from each pair of opposite vertical surfaces to the ground, and steps extending between adjacent extension legs and between adjacent diagonal surfaces to provide an A-shaped structure having a ladder on each leg to the top horizontal surfaces for access to the top of the climber.

* * * * *